United States Patent [19]

Robyn et al.

[11] Patent Number: 4,497,473

[45] Date of Patent: Feb. 5, 1985

[54] COMPOSITE REFRACTORY ARTICLES AND METHOD OF MANUFACTURING THEM

[75] Inventors: Pierre Robyn, Nivelles; Pierre Deschepper, Charleroi, both of Belgium

[73] Assignee: Glaverbel, Brussels, Belgium

[21] Appl. No.: 420,505

[22] Filed: Sep. 17, 1982

[30] Foreign Application Priority Data

Nov. 5, 1981 [GB] United Kingdom ..... 8133409

[51] Int. Cl.[3] ..... B22D 41/08

[52] U.S. Cl. ..... 266/44; 266/281; 266/284; 264/30; 222/600

[58] Field of Search ..... 266/281, 287, 282–286, 266/280, 236; 222/590, 597, 600, 601; 264/30

[56] References Cited

U.S. PATENT DOCUMENTS

| | | | |
|---|---|---|---|
| 1,663,660 | 3/1928 | Hottinger | 266/286 |
| 3,685,707 | 8/1972 | Shapland | 222/600 |
| 3,737,489 | 6/1973 | Murton | 264/30 |
| 4,085,894 | 4/1978 | Kubo et al. | 266/281 |
| 4,192,460 | 3/1980 | Matsuo | 264/30 |

FOREIGN PATENT DOCUMENTS

| | | | |
|---|---|---|---|
| 0694057 | 7/1953 | United Kingdom . | |
| 0836472 | 6/1960 | United Kingdom | 264/30 |
| 1330894 | 9/1973 | United Kingdom . | |
| 1330895 | 9/1973 | United Kingdom . | |
| 2060842 | 5/1981 | United Kingdom | 222/590 |
| 2065278 | 6/1981 | United Kingdom . | |

*Primary Examiner*—L. Dewayne Rutledge
*Assistant Examiner*—S. Kastler
*Attorney, Agent, or Firm*—Spencer & Frank

[57] ABSTRACT

A method of manufacturing a composite refractory article having a flow passage through which a molten metal stream may be conducted and comprising a first body of refractory material which defines a surface of that passage, the first body being bonded to a second body of refractory material. The second body is provided to define a passageway of greater cross-sectional dimensions than the flow passage. Within the passageway, the first body of refractory material is provided for defining the flow passage surface, the first body being formed in the larger passageway by causing its refractory material to cohere and bond to the second body by fusion or partial fusion in situ.

34 Claims, 3 Drawing Figures

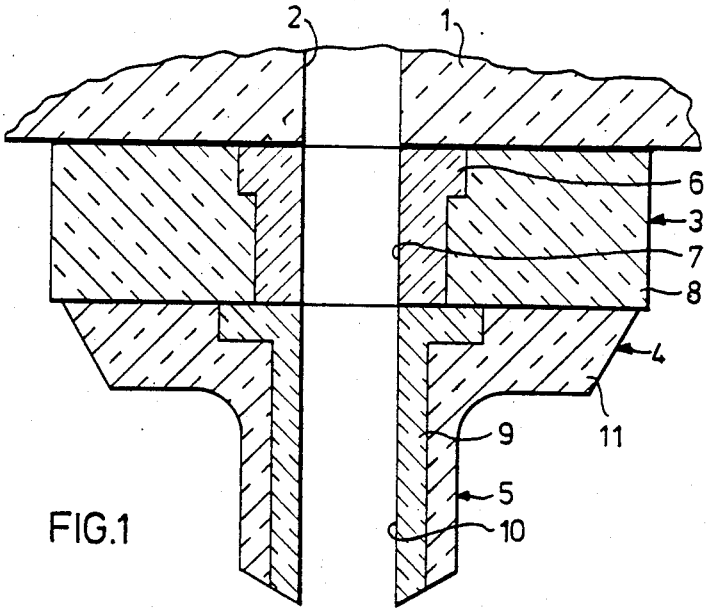
FIG.1
FIG.2
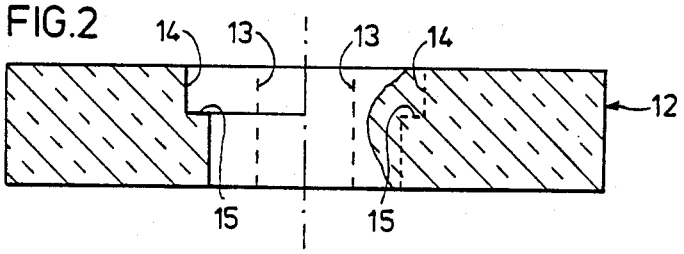
FIG.3
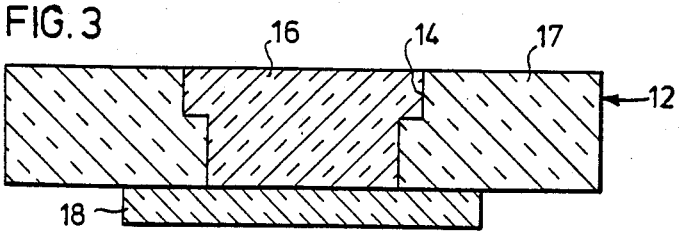

COMPOSITE REFRACTORY ARTICLES AND METHOD OF MANUFACTURING THEM

BACKGROUND OF THE INVENTION

This invention relates to a method of manufacturing a composite refractory article having a flow passage through which a molten metal stream may be conducted and comprising a first body of refractory material which defines a surface of that passage, such first body being bonded to a second body of refractory material. The invention also includes composite refractory articles of the type referred to.

The composite refractory articles with which this invention is particularly concerned are useful as parts of and fittings for apparatus used in metallurgy and more particularly in foundry practice. Such articles include pieces used to guide or control the flow of molten metal streams such as slide plates and collector nozzles of sliding gate valves.

A problem encountered in foundry practice is the erosion of refractory material by a molten metal stream which flows past it. For example it is known to use a magnesia-based sliding gate valve plate for controlling the flow of molten steel from a pot furnace, but generally speaking the valve plate requires replacement each time the pot furnace is filled because the flow of steel through the flow passage in the slide plate tends to enlarge that passage and make it irregular. After use such valve plates are discarded. It is also known to make such vulnerable refractory parts of a higher grade of refractory material such as alumina, but this is expensive. It is also known to cement inserts of high grade refractory material, for example zirconia, into bodies of refractory material at their most vulnerable regions. This is inconvenient in practice since the insert and the remainder of the refractory body must be carefully matched in shape and size.

Furthermore, it is known from Flogates Limited's British Patent Application No. GB 2 065 278 A to form a refractory article having a surface portion which, in service, is contacted by a molten metal stream, comprising an integral composite body having a first refractory member providing the surface portion, a trough or cup shaped metal foil encompassing the first refractory member, and a second, back-up refractory member supporting the foil-encompassed first refractory member, the first refractory member being made from a higher duty refractory material than the second refractory member. This Flogates application also teaches a method of making such a refractory article including the steps of (i) forming a first mould space from a trough or cup shaped metal foil and a companion, permanent mould member the shape of which is a negative of the surface portion; (ii) filling the first mould space with a mouldable refractory concrete and at least partially curing the concrete; (iii) assembling the foil and moulding therein a second mould space formed from companion mould members; (iv) filling the second mould space with a second refractory concrete which is of lower duty than the first concrete; and (v) curing the second concrete and, to the extent that it may not already be completely cured, the first concrete also.

SUMMARY OF THE INVENTION

It is an object of the present inventión to provide new and useful alternative methods of manufacturing composite articles which present certain advantages over what has hitherto been known as will be adverted to in the course of this specification.

According to the present invention, there is provided a method of manufacturing a composite refractory article having a flow passage through which a molten metal stream may be conducted and comprising a first body of refractory material which defines a surface of that passage, the first body being bonded to a second body of refractory material, comprising the steps of providing a second body defining a passageway of greater cross-sectional dimensions than the flow passage and providing within the passageway a first body of refractory material for defining the flow passage surface, the first body being formed in the larger passageway by causing its refractory material to cohere and bond to the second body by fusion or partial fusion in situ.

The method according to the present invention presents the advantages of being applicable both to the manufacture of new refractory articles and to the reconditioning or repair of used refractory articles. The method according to the invention is also especially simple and convenient to put into practice since a surface of the first refractory body formed in the performance of such method will conform to the second refractory body without the need for any special shaping operations.

DETAILED DESCRIPTION OF THE INVENTION

The expression "fusion or partial fusion of refractory material" as used herein denotes an operation in the course of which that material is wholly in the liquid phase or in which particles of refractory material are substantially all melted at at least their surfaces so that on cooling they form a fused coherent mass. Such fusion-bonding is to be distinguished from mere sintering in which a compacted powder is heated to a temperature lower than is necessary to produce a liquid phase but high enough for solid-state reaction or intercrystallisation to take place, and from other bonding techniques in which refractory particles are bonded unfused in a binder matrix, such matrix itself being either fused or not. In the most important embodiments of the invention the first refractory body is composed of fused or partially fused refractory material. The internal structure of the first refractory body which is fused or partially fused together in accordance with this preferred feature of the present invention is different from that of a sintered body or of a body formed by unfused refractory particles in a binder matrix and presents particularly important advantages for the purposes in view since that structure is highly cohesive and resistant to erosion by molten metal.

It is especially preferred that the first refractory body is formed as a relatively high grade refractory body and the second refractory body is formed as a lower grade refractory body. The terms higher and lower grade refractory are used herein to denote relative degrees of resistance to erosion at high temperature. In general, the cost of a refractory body increases with increase in its resistance to erosion at high temperature. Thus the adoption of this feature presents the important advantage of increased cost effectiveness, since the relatively costly high grade first refractory body may form regions of the composite refractory article which are most exposed to erosion while being supported by a lower grade and less costly second refractory body.

Preferably, the first refractory body is formed by a spraying technique. Such spraying may be plasma-spraying, but such body is advantageously formed by flame-spraying a mixture of exothermically oxidisable marterial and other material so as to form a coherent refractory mass. This is a very simple and convenient way of forming a refractory body in situ on another refractory body, and may for example be performed using a process and apparatus as described in Glaverbel's British Pat. Nos. 1,330,894 and 1,330,895.

The oxidisable material is advantageously sprayed in the form of particles having an average size of less than 50 μm and preferably less than 10 μm. Alternatively, or in addition, the oxidisable material may with advantage be sprayed in the form of particles having a specific surface of at least 500 $cm^2$/gram and preferably at least 3000 $cm^2$/gram. These features promote rapid and reliable combustion of the oxidisable material.

The other material is advantageously sprayed in the form of particles having an average grain size below 500 μm.

The oxidisable material advantageously consists at least in part of a metal or metalloid preferably selected from the group: aluminum, magnesium, silicon, zirconium and mixtures of two or more of such materials. Other oxidisable materials which may be used include calcium, manganese and iron.

Advantageously, the combustible material constitutes less than 35% by weight of the mixture sprayed. The proportion of combustible material required depends of course, inter alia, on the amount of heat which must be evolved by the combustion, and the proportion used must be sufficient for that purpose. However another factor to be kept in mind is the amount of unburnt combustible substance (if any) left in the refractory body formed. Especially when using a metal as combustible, it is desirable for all the metal to be burnt since the oxide generally has better refractory properties than the metal. The use of excess metal adds needlessly to costs and can result in an inferior product.

The other material preferably comprises one or more of: zirconia, zircon, silica, alumina, chrome-magnesia, magnesia, these being highly refractory materials.

It will be appreciated that the choice of materials for forming the first refractory body will affect the quality of the bond between that body and the second refractory body in dependence upon the material of which that second body is made. It is also desirable to select the first and second refractory materials so that their coefficients of thermal expansion are similar.

A method according to the invention is particularly valuable in the manufacture of composite refractory articles wherein the first refractory body is formed in a sliding gate valve plate. Such plate may be a slide plate or a plate against which the slide plate slides.

In some preferred embodiments of the invention, such valve plate has an integral collector nozzle at least partially lined by the first refractory body.

It is found especially convenient in practice to form the first refractory body and then drill it to define the flow passage.

As has been referred to before, this invention is not only applicable in the manufacture of new refractory articles, but is also of value in restoring or repairing used refractory articles, and some embodiments of the invention have the preferred optional feature that the first refractory body is formed in a hole made by removing material from around a flow passage of a used refractory article.

The invention includes a composite refractory article manufactured by a method as herein defined.

The invention also includes a composite refractory article having a flow passage through which a molten metal stream may be conducted and comprising a first body of refractory material which defines a surface of that passage, the first body being bonded to a second body of refractory material, characterised in that the first body is formed within a passageway formed in the second body, such passageway being of greater cross sectional dimensions than the flow passage and in that the first body coheres and bonds to the second body by fusion or partial fusion in situ.

The first refractory body is preferably composed of fused or partially fused refractory material.

In preferred embodiments of the invention, the first refractory article is a relatively high grade refractory body and the second body is a lower grade refractory body.

The first refractory body preferably comprises one or more of zirconia, zircon, silica, alumina, chrome-magnesia, magnesia.

Preferably, the materials of the first and second refractory bodies interpenetrate at a boundary layer. Advantageously, the first refractory body surrounds a flow passage in a sliding gate valve plate, and in some preferred embodiments of the invention, the valve plate has an integral collector nozzle at least partially lined by said first refractory body.

Preferred embodiments of the invention will now be described in greater detail with reference to the accompanying diagrammatic drawings in which:

FIG. 1 is a sectional view of a sliding gate valve at the bottom of a pot furnace;

FIG. 2 shows two stages in the repair of a used gate valve slide plate; and

FIG. 3 shows a further stage in the manufacture of a gate valve slide plate according to the invention.

In FIG. 1, the sole 1 of a pot furnace has an orifice 2 for teeming molten metal contained in the furnace. The orifice 2 is closable by a sliding gate valve comprising a slide plate 3 and a second plate (the nozzle plate) 4 which has an integral collector nozzle 5. The slide plate 3 is a composite refractory article consisting of a first refractory body in the form of a hollow plug 6 defining a flow passage 7 and supported by a second refractory body 8 which makes up the bulk of the slide plate. The nozzle plate 4, is also a composite refractory article and consists of a first refractory body 9 in the form of a liner for a flow passage 10 through a second refractory body 11 making up the nozzle plate 4 with its integral collector nozzle 5.

The hollow plug 6 or the liner 9 is formed of a relatively high grade refractory material and is formed in situ in a passageway in the second refractory body 8 or 11 of its respective valve plate 3 or 4 in such a way that it coheres and bonds to the second refractory body 8 or 11 by fusion or partial fusion. Such second refractory body is formed of a lower grade refractory material. Such in situ formation tends to cause inter-penetration of the refractory materials at the boundary between the respective refractory bodies 6 and 8 or 9 and 11.

In addition, the hollow plug 6 or liner 9 may be composed of refractory material which is fused or partially fused and bonded to its respective second refractory body 8 or 11.

FIG. 2 illustrates a stage in the repair of a used slide plate 12 of a sliding gate valve. The slide plate 12 was originally of a single refractory body having a flow passage 13 indicated in dotted lines. During use the flow passage 13 became enlarged by erosion of material as indicated at the right hand side of FIG. 2, this erosion being particularly severe at the ends of the flow passage 13. In order to repair this slide plate 12, additional refractory material is removed from around the flow passage 13 to leave an enlarged passageway 14 whose profile is indicated in solid lines on the left hand side of FIG. 2 and in dotted lines on the right. It will be noted that the profile of the enlarged passageway 14 is stepped to provide a shoulder 15 to provide additional, mechanical support for a refractory plug which is to be contained within that enlarged passageway. As an alternative way of providing such support, the profile of the passageway 14 may be conical. Of course a part conical, optionally stepped, profile may be provided if desired.

After the passageway 14 has been formed, it is filled with a plug 16 (FIG. 3) of refractory material so that the slide plate consists of first and second refractory bodies 16, 17. In fact in normal practice, the plug 16 when first formed may stand proud from the upper surface of the second refractory body 17. In such a case machining will be necessary to provide the slide plate 12 with a flat upper surface. After the plug 16 is formed it is drilled to provide a flow passage such as the flow passage 7 in the slide plate 3 of FIG. 1. In order that the lower surface of the plug 16 may be formed flat, a mould plate 18 of refractory material such as silica or a suitable metal is placed against the under surface of the slide 12 prior to forming the plug.

It is especially suitable to form the plug 16 using apparatus as described in Glaverbel's British Patent specification 1,330,895, that is to say, apparatus for flame spraying a mixture of fine particles comprising combustible (e.g. metal or metalloid) particles and particles of other material such as refractory oxide particles to form a coherent refractory mass.

It will of course be appreciated that the plug 16 of FIG. 3 may equally well be formed in an unused body of refractory material, and that a nozzle plate such as the plate 4 of FIG. 1 may equally be manufactured or repaired in a similar way.

Example 1

In order to form a plug in a body of basic refractory material consisting mainly of magnesia, a mixture of particles was prepared and projected into a hole formed in the basic type refractory material using the apparatus described in British Patent specification No. 1,330,895.

The refractory body was preheated to 500° C.

The mixture of particles was projected at a rate of 20 kg/hour in a stream of oxygen delivered at 13000 L/hour and had the following composition by weight: $ZrO_2$ 45%, $SiO_2$ 28%, $Al_2O_3$ 15%, Si 12%. The silicon particles had a maximum average grain size of 10 μm and a specific surface of 5000 $Cm^2$/gram, and the other particles had a maximum average grain size of 500 μm. The heat of combustion of the silicon was sufficient to melt at least the surface of the other particles so as to form a coherent plug of refractory material which was fused together and directly bonded to the magnesia type refractory body.

Example 2

In a variant of Example 1, the oxide particles of the projected mixture were replaced by $ZrO_2$ (50% by weight of the mixture) and $Al_2O_3$ (38%).

Example 3

In order to form a plug in a basic refractory block consisting mainly of magnesia, a starting mixture of finely divided particles consisting of 40% MgO, 40% $ZrO_2$ and 20% of silicon was projected at a rate of 0.7Kg/minute in an oxygen stream delivered at 240 L/minute.

The block was preheated to a temperature of about 500° C.

Again a coherent mass of fused-together refractory material was obtained.

In a variant of this Example, small quantities of $SiO_2$ were present in the starting mixture.

Example 4

In order to form a plug in a basic refractory block consisting mainly of magnesia, a starting mixture of finely divided particles consisting of, by weight, 60% chrome-magnesia, 20% $ZrO_2$ and 20% combustible material was projected at a rate of 0.7 kg/minute in an oxygen stream delivered at 240 L/minute. The combustible material used was silicon, and the block was preheated to a temperature of 500° C. before spraying.

Example 5

A basic refractory block was plugged by projecting, at a rate of 0.7 kg/minute in an oxygen stream delivered at 220 L/minute a mixture of finely divided particles consisting of, by weight, 15% $Al_2O_3$, 12% $SiO_2$, 60% $ZrSiO_4$ and 13% combustible material.

The block was preheated to 500° C.

We claim:

1. A method for manufacturing a composite refractory article having a flow passage through which a molten metal stream may be conducted, said article comprising a first body of a relatively high grade refractory material which defines an axially extending surface of that passage, said first body being fused to a second body of relatively lower grade refractory material; comprising the steps of producing said second body defining a passageway of greater cross-sectional dimensions than said flow passage and providing within said passageway said first body of refractory material for defining said flow passage surface, said first body being formed in a sliding gate valve plate and being formed in the larger passageway by causing its refractory material to cohere and bond to said second body by fusion or partial fusion in situ.

2. A method according to claim 1 wherein said first refractory body is composed of fused or partially fused refractory material.

3. A method according to claim 1, wherein said first refractory body is formed by a spraying technique.

4. A method according to claim 3, wherein said first refractory body is formed by flame spraying a mixture of exothermically oxidizable material and other material so as to form a coherent refractory mass.

5. A method according to claim 4, wherein said oxidizable material is sprayed in the form of particles having an average size of less than 50 μm and preferably less than 10 μm.

6. A method according to claim 4, wherein said oxidizable material is sprayed in the form of particles having a specific surface of at least 500 $cm^2$/gram 7. A method according to any of claims 4 to 6, wherein said other material is sprayed in the form of particles having an average size below 500 μm.

8. A method according to claim 4, wherein said oxidizable material consists at least in part of a metal or metalloid.

9. A method according to claim 4, wherein said oxidizable material constitutes less than 35% by weight of the mixture sprayed.

10. A method according to claim 4, wherein said other material comprises one or more of zirconia, zircon, silica, alumina, chrome-magnesia, magnesia.

11. A method according to claim 1, wherein said valve plate has an integral collector nozzle at least partially lined by said first refractory body.

12. A method according to claim 1, wherein said first refractory body is formed in a hole made by removing material from around a flow passage of a used refractory article.

13. A method according to claim 8, wherein the metal or metalloid is selected from the group: aluminum, magnesium, silicon, zirconium and mixtures of two or more of such materials.

14. A method according to claim 4, wherein said oxidizable material is sprayed in the form of particles having a specific surface of at least 3000 $cm^2$/gram.

15. A method of manufacturing a composite refractory article having a flow passage through which a molten metal stream may be conducted and comprising a first body of refractory material which defines a surface of that passage, said first body being bonded to a second body of refractory material, comprising the steps of providing said second body defining a passageway of greater cross-sectional dimensions than said flow passage surface, said first body being formed in the larger passageway by causing its refractory material to cohere and bond to said second body, by fusion or partial fusion, in situ, said first body being formed and then drilled to define said flow passage.

16. A method according to claim 15 wherein said first refractory body is composed of fused or partially fused refractory material.

17. A method according to claim 15, wherein said first refractory body is formed as a relatively high grade refractory body and said second body is formed as a relatively lower grade refractory body.

18. A method according to claim 15, wherein said first refractory body is formed by a spraying techinque.

19. A method according to claim 18, wherein said first refractory body is formed by flame spraying a mixture of exothermically oxidizable material and other material so as to form a coherent refractory mass.

20. A method according to claim 19, wherein said oxidizable material is sprayed in the form of particles having an average size of less than 50 μm and preferably less than 10 μm.

21. A method according to claim 19, wherein said oxidizable material is sprayed in the form of particles having a specific surface of at least 500 $cm^2$/gram.

22. A method according to claim 19, wherein said oxidizable material is sprayed in the form of particles having a specific surface of at least 3000 $cm^2$/gram.

23. A method according to claim 19, wherein said other material is sprayed in the form of particles having an average size below 500 μm.

24. A method according to claim 19, wherein said oxidizable material consists at least in part of a metal or metalloid.

25. A method according to claim 19, wherein said oxidizable material constitutes less than 35 percent by weight of the mixture sprayed.

26. A method according to claim 19, wherein said other material comprises one or more of zirconia, zircon, silica, alumina, chrome-magnesia, magnesia.

27. A method according to claim 15, wherein said first refractory body is formed in a sliding gate valve plate.

28. A method according to claim 27, wherein said valve plate has an integral collector nozzle at least partially lined by said first refractory body.

29. A method according to claim 15, wherein said first refractory body is formed in a hole made by removing material from around a flow passage of a used refractory article.

30. A composite refractory article having a flow passage through which a molten metal stream may be conducted and comprising a first body of a relatively high grade refractory material which defines a surface of that passage, said refractory article surrounding a flow passage in a sliding gate valve plate, said first body being bonded to a second body of a relatively lower grade refractory material, wherein said first body is formed within a passageway formed in said second body, such passageway being of greater cross sectional dimesions than said flow passage and in that said first body coheres and bonds to the second body by fusion or partial fusion in situ.

31. An article according to claim 30, wherein said first refractory body is composed of fused or partially fused refractory material.

32. An article according to claim 30, wherein said first refractory body comprises one or more of zirconia, zircon, silica, alumina, chrome-magnesia, magnesia.

33. An article according to claim 30, wherein said valve plate has an integral collector nozzle at least partially lined by said first refractory body.

34. An article according to claim 30, wherein the materials of said refractory bodies interpenetrate at a boundary layer.

* * * * *